US008564179B2

(12) United States Patent
Ochoa et al.

(10) Patent No.: US 8,564,179 B2
(45) Date of Patent: Oct. 22, 2013

(54) APPARATUS AND METHOD FOR DOWNHOLE ENERGY CONVERSION

(75) Inventors: Brian B. Ochoa, Hannover (DE); Thomas Kruspe, Wietzendorf (DE); Volker Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 104 days.

(21) Appl. No.: 13/196,427

(22) Filed: Aug. 2, 2011

(65) Prior Publication Data

US 2012/0032560 A1 Feb. 9, 2012

Related U.S. Application Data

(60) Provisional application No. 61/370,258, filed on Aug. 3, 2010.

(51) Int. Cl.
*H01L 41/08* (2006.01)

(52) U.S. Cl.
USPC ..... 310/339; 310/328

(58) Field of Classification Search
USPC ..... 310/328, 330–332, 339, 345
See application file for complete search history.

(56) References Cited

U.S. PATENT DOCUMENTS

| | | | | |
|---|---|---|---|---|
| 4,467,236 | A | 8/1984 | Kolm et al. | |
| 4,491,738 | A | 1/1985 | Kamp | |
| 5,554,922 | A | 9/1996 | Kunkel | |
| 5,839,508 | A | 11/1998 | Tubel et al. | |
| 6,011,346 | A | 1/2000 | Buchanan et al. | |
| 7,762,354 | B2 * | 7/2010 | Garcia-Osuna | 175/56 |
| 8,284,075 | B2 * | 10/2012 | Fincher et al. | 340/854.4 |
| 2008/0142215 | A1 | 6/2008 | Pabon et al. | |
| 2009/0034368 | A1 | 2/2009 | Johnson | |
| 2009/0078413 | A1 | 3/2009 | Tubel et al. | |
| 2010/0025032 | A1 | 2/2010 | Smith et al. | |

OTHER PUBLICATIONS

International Search Report and Written Opinion dated Jan. 5, 2012 for International Application No. PCT/US2011/046431.

* cited by examiner

*Primary Examiner* — Mark Budd
(74) *Attorney, Agent, or Firm* — Cantor Colburn LLP

(57) ABSTRACT

An apparatus for generating electrical energy in downhole tool is disclosed. In one exemplary embodiment, such apparatus includes a tubular configured to flow a fluid within the tubular and an energy conversion device at a selected location inside the tubular, wherein the energy conversion device comprises an active material configured to convert received pressure pulses in the fluid into electrical energy.

20 Claims, 3 Drawing Sheets

APPARATUS AND METHOD FOR DOWNHOLE ENERGY CONVERSION

CROSS-REFERENCE TO RELATED APPLICATION

This application takes priority from U.S. Provisional application Ser. No. 61/370,258, filed on Aug. 3, 2010, which is incorporated herein in its entirety by reference.

BACKGROUND

1. Field of the Disclosure

This disclosure relates generally to downhole tools and systems for using same.

2. Background of the Art

Oil wells (also referred to as wellbores or boreholes) are drilled with a drill string that includes a tubular member (also referred to as a drilling tubular) having a drilling assembly (also referred to as bottomhole assembly or "BHA") which includes a drill bit attached to the bottom end thereof. The drill bit is rotated to disintegrate the rock formation to drill the wellbore and thus enable completion of the borehole. The BHA and the tubular member include devices and sensors for providing information about a variety of parameters relating to the drilling operations (drilling parameters), the behavior of the BHA (BHA parameters) and the formation surrounding the wellbore being drilled (formation parameters). The devices and sensors use power to perform measurements. Power can be supplied by a line or cable conveyed downhole. Conveying electric lines downhole can be costly and expensive. In other applications, batteries are used to power the downhole devices and sensors. However, batteries are expensive, occupy a significant amount of space and may not meet certain environmental regulations.

SUMMARY

In one aspect, an apparatus for generating electrical energy in downhole tool is disclosed. In one exemplary embodiment, such apparatus includes a tubular configured to flow a fluid within the tubular and an energy conversion device at a selected location in the tubular, wherein the energy conversion device comprises an active material (or element or member) configured to convert pressure pulses in the fluid into electrical energy.

In another aspect, a method for generating electrical energy in a downhole tool is disclosed, which method, in one exemplary embodiment, may include flowing a fluid within a tubular downhole, inducing pressure pulses in the fluid at a selected location in the tubular, and using an active material to convert the induced pressure pulses into electrical energy.

The disclosure provides examples of various features of the apparatus and apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DETAILED DESCRIPTION OF THE EMBODIMENTS

Figure 1:
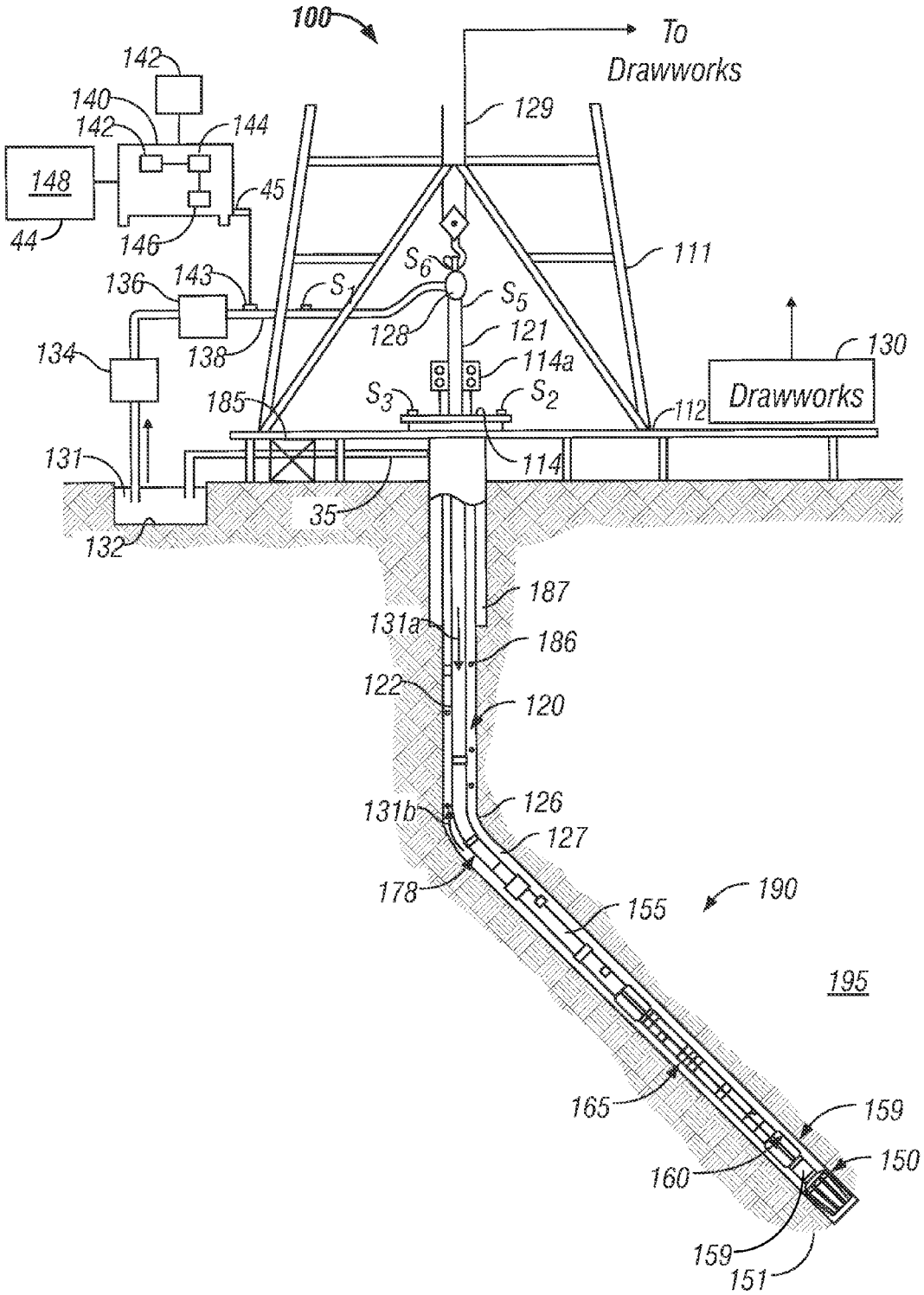
FIG. 1 is an elevation view of a drilling system including energy conversion devices, according to an embodiment of the present disclosure.

FIG. 1 is a schematic diagram of an exemplary drilling system 100 that includes a drill string having a drilling assembly attached to its bottom end that includes a steering unit according to one embodiment of the disclosure. FIG. 1 shows a drill string 120 that includes a drilling assembly or bottomhole assembly ("BHA") 190 conveyed in a borehole 126. The drilling system 100 includes a conventional derrick 111 erected on a platform or floor 112 that supports a rotary table 114 is rotated by a prime mover, such as an electric motor (not shown), at a desired rotational speed. A tubing (such as jointed drill pipe) 122, having the drilling assembly 190 attached at its bottom end, extends from the surface to the bottom 151 of the borehole 126. A drill bit 150, attached to drilling assembly 190, disintegrates the geological formations when it is rotated to drill the borehole 126. The drill string 120 is coupled to a draw works 130 via a Kelly joint 121, swivel 128 and line 129 through a pulley. Draw works 130 is operated to control the weight on bit ("WOB"). The drill string 120 may also be rotated by a top drive (not shown) rather than the prime mover and the rotary table 114. The operation of the draw works 130 is known in the art and is thus not described in detail herein.

In an aspect, a suitable drilling fluid 131 (also referred to as "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 provide information about the torque and the rotational speed of the drill string 120. Rate of penetration of the drill string 120 may be determined from the sensor $S_5$, while the sensor $S_6$ may provide the hook load of the drill string 120.

In some applications, the drill bit 150 is rotated by rotating the drill pipe 122. However, in other applications, a downhole motor 155 (mud motor) disposed in the drilling assembly 190 also rotates the drill bit 150. The rate of penetration ("ROP") for a given drill bit and BHA largely depends on the WOB or the thrust force on the drill bit 150 and its rotational speed.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided by a program to the surface control unit 140. The surface control unit 140 displays desired drilling parameters and other information on a display/monitor 142 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole and may control one or more operations of the downhole and surface devices.

The drilling assembly 190 may also contain formation evaluation sensors or devices (also referred to as measurement-while-drilling, "MWD," or logging-while-drilling, "LWD," sensors) determining resistivity, density, porosity, permeability, acoustic properties, nuclear-magnetic resonance properties, corrosive properties of the fluids or formation downhole, salt or saline content, and other selected properties of the formation 195 surrounding the drilling assembly 190. Such sensors are generally known in the art and for convenience are generally denoted herein by numeral 165. The drilling assembly 190 may further include a variety of other sensors and communication devices 159 for controlling and/or determining one or more functions and properties of the drilling assembly (such as velocity, vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.

Still referring to FIG. 1, the drill string 120 further includes energy conversion devices 160 and 178. In an aspect, the energy conversion device 160 is located in the BHA 190 to provide an electrical power or energy, such as current, to sensors 165 and/or communication devices 159. Energy conversion device 178 is located in the drill string 120 tubular, wherein the device provides current to distributed sensors located on the tubular. As depicted, the energy conversion devices 160 and 178 convert or harvest energy from pressure waves in a fluid, such as drilling mud, which are received by and flow through the drill string 120 and BHA 190. Thus, the energy conversion devices 160 and 178 utilize an active material to directly convert the received pressure waves into electrical energy. As depicted, the pressure pulses are generated at the surface by a modulator, such as a telemetry communication modulator, and/or as a result of drilling activity and maintenance. Accordingly, the energy conversion devices 160 and 178 provide a direct and continuous source of electrical energy to a plurality of locations downhole without power storage (battery) or an electrical connection to the surface.

Figure 2:
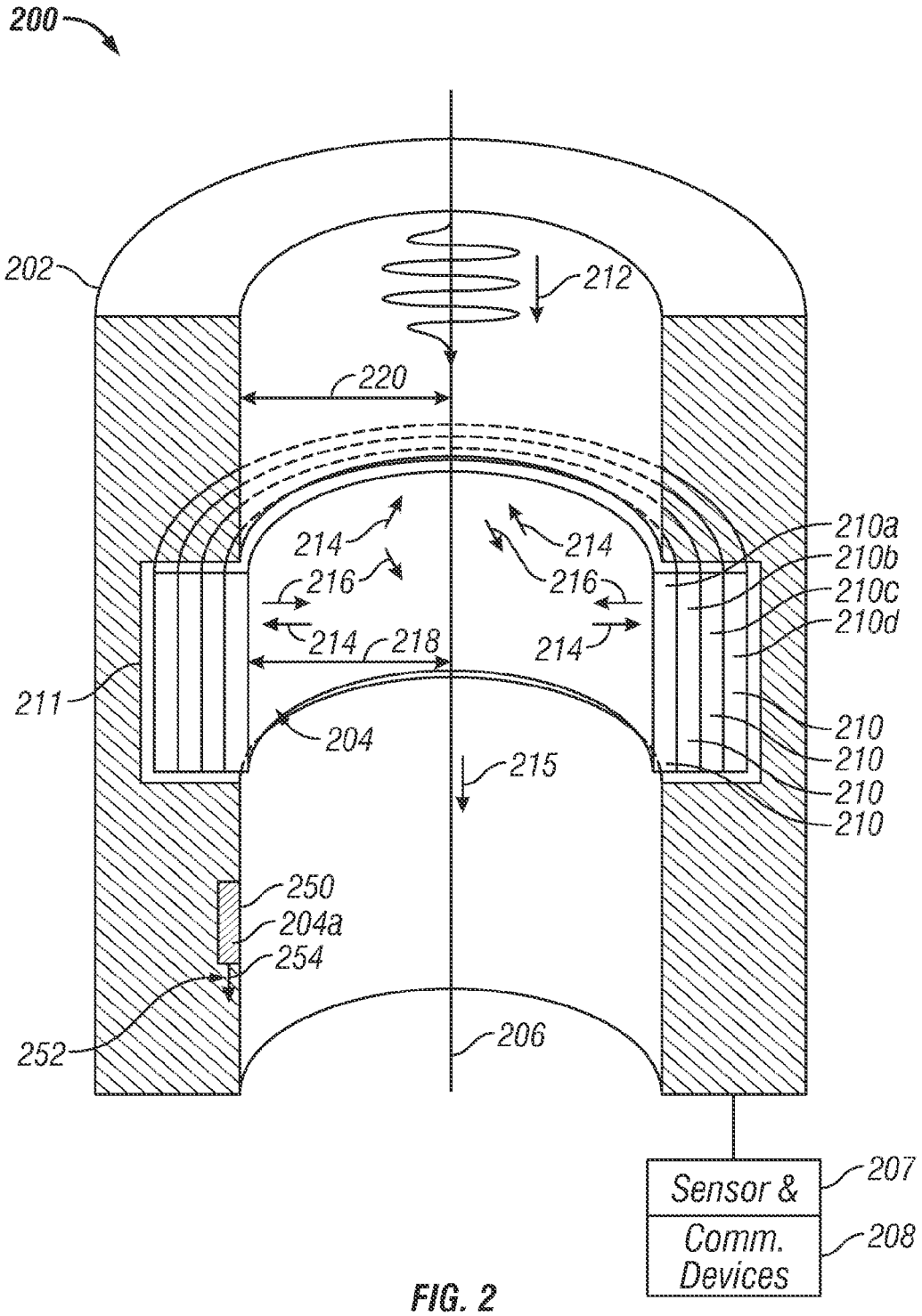
FIG. 2 is a sectional side view of an embodiment a portion of a drill string and an energy conversion device, according to an embodiment of the present disclosure.

FIG. 2 is a sectional side view of an embodiment of a portion or segment of a drill string 200. The portion of the drill string 200 is shown to include a tubular member 202 and an energy conversion device 204 disposed about a centerline axis 206 of the tubular 202. The energy conversion device 204 may be of any suitable shape, size or structure, including, but not limited to, rings and/or sections of rings, cylinders and/or sections of cylinders, pads and hexahedrons (or any hedron-shaped member). In an embodiment, the energy conversion device 204 includes one or more rings 210, such as rings 210*a*, 210*b*, 210*c*, 210*d*, etc. In one configuration, the rings 210 may be located within a recess or recessed portion 211 of the tubular 202. In another embodiment, the rings 210 are each comprised of sections of rings. In an embodiment, each of the rings 210*a*-210*d* may include an active material or member configured to convert pressure pulses 215 present in the fluid 215 in the tubular 202 to electrical energy, such as current. The fluid 215 may be any suitable fluid, such as drilling fluid or mud or production fluid, in case of completed wells. The pressure pulses 212 may be generated at the surface or in the drill string 200 as described in more detail later. The rings 210 may be concentric ring structures having a passage 220 for the flow of the fluid flow 215 therethrough. In aspects, the plurality of rings 210 may provide more flexibility for the active material as they expand and contract due to their interaction with the pressure pulses 215, thereby producing more energy from the pulses. As the pressure pulses 212 pass through the energy conversion device 204, the rings 210 expand and contract, as shown by arrows 214 and 216, respectively. In an aspect, the active material in the rings 210 may include piezoelectric elements coupled to or in pressure communication with any suitable flexible material, including, but not limited to, a composite material, carbon fiber, plastic, rubber and metallic material. In such configurations, the active material changes shape by expanding and contracting (214, 216) that induces stress and strain on the piezoelectric elements, that in response to such stresses and strains generates electrical current 222. The current 222 generated may be transported to a suitable location via conductors 224, such as to power a sensor or one or more devices (208) downhole. In the depicted embodiment, an inner dimension (e.g. radius 218) of the passage in the energy conversion device 204 is substantially equal to an inner radius of the tubular 202. As a result, the passage through the energy conversion device 204 provides a flow path for the drilling fluid 215, which passage, in aspects, may provide a non-turbulent flow path to the drilling fluid In one aspect, the energy conversion device 204 comprises at least one ring-shaped flexible structure with a plurality of piezoelectric elements in the structure. The piezoelectric elements are configured to generate an electric potential and corresponding voltage (and current) across the material in response to applied mechanical strain, in the form of the expanding and contracting rings 210. The generated voltage and current is routed to conductors 224 coupled to one or more sensors 207 and communication devices 208. In the configuration of the power generation device shown in FIG. 2, the power generation device 204 converts pressure pulses 212 normally present in the fluid 215 in the drill string 202 into electrical energy, without inhibiting the flow of the drilling fluid through the tubular 202. Non-limiting examples of piezoelectric materials include crystals and certain ceramics. It should be noted that the active element of the energy conversion device 204 may include any suitable material that converts flexing or movement of a portion or all of the device, and the corresponding mechanical stress and strain, into electrical energy. In another embodiment, an energy conversion device 204*a* may include one or more pads 250 positioned inside the walls of the tubular 202. The pads 250 include an active material that deforms or flexes as the pressure pulses 212 pass through the energy conversion device 204. Thus, the flexing of one or more pads 250 and corresponding strain on its active elements generates a current 252 that may be routed from the energy conversion device 204*a* to a device, such as device 208 by conductors 254. The energy conversion devices 204, 204*a* may positioned in a plurality of locations within the drill string (FIG. 1, 120), such as the BHA, and/or throughout the drilling string 200. Thus, sensors and communication devices in each such location may be powered by a local energy conversion device 204, 204*a* utilizing the pressure pulses that pass through such devices.

In aspects, the pressure pulses 212 may be generated in the fluid 215 being pumped into the drill string by the mud pump 134 (FIG. 1) at the surface. Pressure pulses are generated when the mud is pumped into the drill string 200. Pressure pulses may also be generated in the fluid 215 in the drill string by a pulser located in the drill string 200 or at the surface for transmission and communication of data between the surface and downhole locations. Although the mud pumps are located at the surface, they still can produce adequate amplitudes of pressure pulses downhole. For example, a mud pump can produce pressure fluctuation of about 40 bars at the surface. Such pressure fluctuations in the fluid downhole still may remain between 2-4 bars, which level of energy is sufficient to induce adequate stresses and strains in the active materials to generate electrical power. Also, the active material of the energy conversion devices 204, 204*a* may be configured to flex and strain in response to received pressure pulses of a selected frequency and amplitude and generate energy downhole. For example, mud pulse telemetry pulses may be generated at a first frequency and amplitude by a first modulator and additional pressure pulses may be generated at a second frequency and amplitude by a second modulator. The second frequency and amplitude may both be higher than the first frequency and amplitude, enabling telemetry communication at one frequency while energy is supplied to the active materials via pulses at a second frequency. The modulator may be any suitable pulser, such as a pulser in the fluid path or a pulser that induces energy into the fluid in the form of pressure pulses. In an alternative embodiment, pressure pulses may be selectively generated to power downhole devices at desired times, wherein a modulator at the surface produces the pulses when the downhole sensors use power to measure downhole parameters. Therefore, when measurement by the downhole sensors is complete and sensors do not need power, the modulator is idle and does not produce pulses for the energy conversion device. It should be understood that the energy conversion device 204 may be used to provide power downhole for any suitable application, including but not limited to, drilling operations, completion operations and productions operations.

Figure 3:
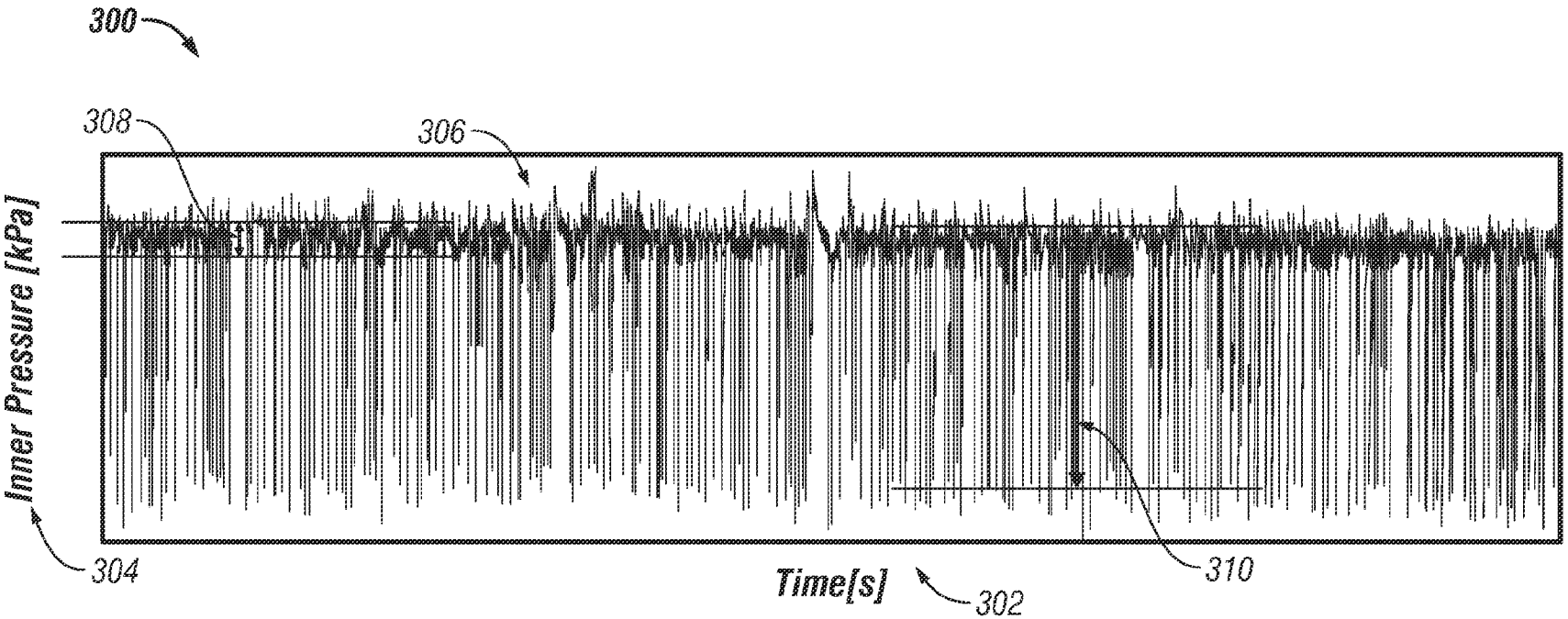
FIG. 3 is a graph of pressure pulse data, according to an embodiment of the present disclosure.

FIG. 3 is a graph 300 of pressure pulse data for an embodiment of a drill string, such as those shown in FIGS. 1 and 2. The graph 300 displays data corresponding to time 302 (x-axis) and pressure 304 (y-axis), sensed by one or more sensors positioned inside the drill string tubular. Sensed pressure data over time 306 illustrates the pressure fluctuations and pulses in the drilling fluid that are used by the energy conversion device 204 (FIG. 2) to power downhole devices. As depicted, at least two sources of pressure pulses are sensed. A first set of pressure pulses 308 show pulses induced or created by a mud telemetry pulser (or "modulator"). A second set of pressure pulses 310 show pulses induced by fluctuation of mud pumps. In an embodiment, the telemetry pulses 308 have lower amplitude than the amplitude of mud pump pulses 310. Further, the telemetry pulses 308 have a higher frequency than the mud pump pulses 310. In one aspect, the energy conversion device 204 converts the pressure pulses received from the mud pump and/or the telemetry pulser to create energy, such as current, to power devices downhole. Accordingly, in one configuration, the pressure pulses are generated uphole of the energy conversion device 204, thereby enabling energy harvesting or conversion at one or more locations in the drill string and BHA. It should be noted that pressure pulses may be generated by any suitable source uphole, including but not limited to, pressure pulse generating devices that generate data signal (also referred to as pulsers), mud pumps, dedicated modulators that generate pressure pulses for detection by the energy conversion device and/or any other mechanism. The pressure pulsing source or device may be coupled to a controller, including a processor, such as a microprocessor, and one or more software programs stored in a memory device or data storage device accessible to the processor configured to control pressure pulse generation. In aspects, the energy conversion device 204 is an apparatus that provides power downhole without certain components, such as electrical lines from the surface or a battery, using "existing" pressure pulses that may occur in a drill string/wellbore system.

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

The invention claimed is:

1. An apparatus for use in a wellbore, comprising:

a tubular configured to flow a fluid within the tubular that includes pressure pulses generated by a source thereof; and an energy conversion device in the tubular, the energy conversion device including an active member configured to generate electrical energy in response to pressure pulses in the fluid, wherein the pressure pulses for generating electrical energy are generated by a modulater that is different from a telemetry modulator, the pressure pulses having at least one of a different frequency and a different amplitude than telemetry pulses.

2. The apparatus of claim 1, wherein the energy conversion device is concentric with the tubular and includes a fluid passage therethrough.

3. The apparatus of claim 2, wherein the energy conversion device includes one or more rings or sections of the rings and wherein each ring or section of the ring includes an active member and a flexible member.

4. The apparatus of claim 3, wherein the one or more rings or sections of the rings are located in a recess in the tubular.

5. The apparatus of claim 1, wherein the energy conversion device is placed at a location selected from a group consisting of: inside a fluid passage in the tubular; in a recess inside the tubular and at a raised portion of the tubular.

6. The apparatus of claim 1 further comprising a source for generating pressure pulses in the fluid that is selected from a group consisting of a: mud pump at a surface location; device in the fluid configured to generate pressure pulses in the fluid; and device configured to add energy to the fluid to generate pressure pulses in the fluid.

7. The apparatus of claim 1, wherein the energy conversion device further includes a flexible member coupled to the active member and wherein the pressure pulses act on the flexible member to cause the active member to generate the electrical energy.

8. The apparatus of claim 7, wherein the active member includes a piezoelectric member and the flexible member includes one of: rubber; plastic; a composite material, carbon fiber material; and a metallic member.

9. The apparatus of claim 1, wherein the energy generation device includes a member selected from a group consisting of a: cylinder; section of a cylinder; ring; section of a ring; pad; planar member; and hedron-shaped member.

10. The apparatus of claim 1, wherein the energy conversion device is placed at a location selected from a group consisting of: a recess in the tubular; an offset location from an inside of the tubular; and a raised portion of the tubular.

11. The apparatus of claim 1, wherein the energy conversion device is configured to directly provide electrical energy to a downhole device.

12. A method for generating electrical energy downhole, comprising:

flowing a fluid within a tubular deployed in a wellbore;

generating pressure pulses in the fluid from a source thereof;

providing an energy conversion device in the tubular, the energy conversion device including an active member configured to generate electrical energy in response to pressure pulses in the fluid, wherein the pressure pulses for generating electrical energy are generated by a modulater that is different from a telemetry modulator, the pressure pulses having at least one of a different frequency and a different amplitude than telemetry pulses; and generating electrical energy by the energy conversion device.

13. The method of claim 12, wherein providing the energy conversion device comprises providing a device that is concentric with the tubular and includes a fluid passage therethrough.

14. The method of claim 12, wherein providing the energy conversion device includes providing one or more rings or sections of rings, each such ring or section of the ring including an active member and a flexible member.

15. The method of claim 12, wherein providing the energy conversion device further comprises placing the energy conversion device at a location selected from a group consisting of: inside a fluid passage in the tubular; in a recess in the tubular; and at a raised portion of the tubular.

16. The method of claim 12, wherein the source for generating pressure pulses in the fluid is selected from a group consisting of a: mud pump at a surface location; device in the fluid configured to generate pressure pulses in the fluid; and device configured to add energy to the fluid to generate pressure pulses in the fluid.

17. The method of claim 12, wherein the active member includes a piezoelectric member and the flexible member includes one of: rubber; plastic; a composite material, carbon fiber material; and a metallic member.

18. The method of claim 12, wherein providing the energy generation device includes providing a device selected from a group consisting of a: cylinder; section of a cylinder; ring; section of a ring; pad; planar member and hedron-shaped member.

19. The method of claim 12, wherein providing the energy conversion device further comprises placing the energy conversion device at a location selected from a group consisting of: a recess in the tubular; inside of the tubular, and a raised portion of the tubular.

20. The method of claim 12, further comprising providing the generated electrical energy to a device downhole.

* * * * *